US008434435B2

(12) United States Patent
Engineer

(10) Patent No.: US 8,434,435 B2
(45) Date of Patent: May 7, 2013

(54) VARIABLE COMPRESSION RATIO SYSTEM FOR INTERNAL COMBUSTION ENGINES AND METHOD OF VARYING COMPRESSION RATIO

(75) Inventor: Nayan Engineer, Canton, MI (US)

(73) Assignees: Hyundai Motor Company, Seoul (KR); Hyundai America Technical Center, Inc., Superior Township, MI (US); Kia Motors Corporation, Seoul (KR)

( * ) Notice: Subject to any disclaimer, the term of this patent is extended or adjusted under 35 U.S.C. 154(b) by 709 days.

(21) Appl. No.: 12/625,463

(22) Filed: Nov. 24, 2009

(65) Prior Publication Data

US 2011/0120421 A1 May 26, 2011

(51) Int. Cl.
*F02B 75/04* (2006.01)

(52) U.S. Cl.
USPC ..... 123/48 B; 123/48 A

(58) Field of Classification Search ..... 123/48 B, 123/48 R, 48 AA, 78 AA, 78 BA, 78 R, 78 B, 123/78 E
See application file for complete search history.

(56) References Cited

U.S. PATENT DOCUMENTS

| | | | | |
|---|---|---|---|---|
| 5,417,185 | A * | 5/1995 | Beattie | 123/48 B |
| 6,601,551 | B1 * | 8/2003 | Rabhi | 123/78 E |
| 6,752,105 | B2 * | 6/2004 | Gray, Jr. | 123/48 B |
| 7,377,238 | B2 * | 5/2008 | Ishikawa et al. | 123/43 R |
| 7,762,066 | B2 * | 7/2010 | Cannata | 60/414 |

OTHER PUBLICATIONS

Kadota, M., et al., "Advanced Control System of Variable Compression Ratio (VCR) Engine with Dual Piston Mechanism"; SAE International, 2009.
Ishikawa, S., et al.; "Advanced Design of Variable Compression Ratio Engine with Dual Piston Mechanism", SAE International, 2009.
Wittek K., et al.; "Two-Stage Variable Compression Ratio with Eccentric Piston Pin and Exploitation of Crank Train Forces"; SAE International; 2009.
Shaik, A, et al.; "Variable Compression Ratio Engine: A Future Power Plant for Automobiles—An Overview"; Proc. IMechE vol. 221 Part D: J. Automobile Engineering; 2007.
Roberts, M. "Benefits and Challenges of Variable Compression Ratio (VCR)"; Society of Automotive Engineers, Inc.; 2002.

* cited by examiner

*Primary Examiner* — Noah Kamen
*Assistant Examiner* — Hung Q Nguyen
(74) *Attorney, Agent, or Firm* — Edwards Wildman Palmer LLP; Peter F. Corless

(57) ABSTRACT

A system for adjusting a compression ratio of an internal combustion engine, includes a piston position adjusting mechanism having a lever pivotably mounted on each of the connecting rods, adapted and configured to pivot when actuated, a cam, rotatably mounted with respect to each of one or more pistons and respective connecting rods, adapted and configured to maintain, at any moment, one of a plurality of spacings therebetween, rotation of the cam by a preselected angle causing a change in relative spacing between the head of the respective piston and small end of the connecting rod. The trigger is adapted and configured to cause pivoting of the lever, engagement between the cam and the lever, and rotation of the cam by the preselected angle.

20 Claims, 16 Drawing Sheets

VARIABLE COMPRESSION RATIO SYSTEM FOR INTERNAL COMBUSTION ENGINES AND METHOD OF VARYING COMPRESSION RATIO

TECHNICAL FIELD

The present invention relates to a system for adjusting a compression ratio of a reciprocating-type internal combustion engine, and the related method. Particularly, the present invention is directed to a system that varies the compression ratio by permitting shifting of at least the top dead center position of the engine pistons upward, with respect to the cylinder bore, thereby proportionately increasing the compression ratio, and the related method.

BACKGROUND ART

Internal-combustion engines, such as those in most automobiles, are typically designed with a plurality of reciprocating pistons, each actuated by a connecting rod pivotably connected to the pistons, and eccentrically and rotatably connected to a crankshaft, which ties the plurality of pistons together, and determines their relative position within the engine during the engine cycle. The crankshaft is generally held within a block portion of the engine, while the pistons reciprocatingly slide within respective cylinder bores within an upper portion of the engine block. Combustion occurs within the combustion chamber of each cylinder, defined between the top of the piston, the wall of the cylinder bore, and the head of the cylinder.

In reciprocating internal combustion engines, the combustion ratio (r) is the maximum volume of each cylinder's combustion chamber (Vmax) in relation to the minimum volume of each cylinder's combustion chamber (Vmin), expressed either as a ratio or as the quotient of the two volumes. The maximum cylinder volume is calculated when the piston is positioned at the bottom of its range—at bottom dead center (BDC), with the minimum cylinder volume being calculated when the piston is positioned at the top of its range—top dead center (TDC). The distance traveled between TDC and BDC positions is termed the "stroke" of the piston. Even at the TDC position, a clearance volume typically remains above the piston. The clearance volume is the remaining volume of the cylinder, when the piston is at the TDC position (Vmin). In summary, the compression ratio (r) is defined as shown below.

$$r = \frac{V_{max}}{V_{min}} = \frac{V_{BDC}}{V_{TDC}}$$

The compression ratio (r) affects various aspects of engine performance, and depending on the compression ratio, power output and/or fuel efficiency and/or engine noise and vibrations, as well as other combustion characteristics can be modified. All production engines have a fixed compression ratio, which is limited by occurrence of "knock," due to premature fuel combustion, under full-load operation. Under partial-load operation the engine can be satisfactorily run at a higher compression ratio for higher thermal efficiency, lower fuel consumption and reduced emissions. However, lower compression ratios necessitated by full-load operation characteristics limits an engine from achieving any of the benefits of a higher compression ratio—namely higher efficiency, lower fuel consumption and reduced emissions under partial-loads.

Systems have been developed previously for adjusting compression ratios of internal combustion engines, many of which are excessively complicated, resulting in increased weight and cost, and reduced reliability. Some of such systems rely on variable cylinder volume, such as by repositioning the cylinder head, and thus the cylinders, with respect to the crankshaft and piston TDC (and BDC) positions. Other systems rely on variability of the piston top dead center. Some of such systems function by moving the crankshaft, and thus the TDC (and BDC) positions with respect to the cylinders, others function by adjusting connecting rod position with respect to the crankshaft by adjusting the height dimension of the piston itself, for example.

The above-described proposed systems and methods have generally proven unworkable due to their complexity, cost and unreliability. Therefore, a continued need exists for systems to vary compression ratios to achieve efficiency in fuel economy, that is simple, reliable and relatively inexpensive. The present invention provides a solution for these continued needs.

The above information disclosed in this Background section is only for enhancement of understanding of the background of the invention and therefore it may contain information that does not form the prior art that is already known in this country to a person of ordinary skill in the art.

SUMMARY

The purpose and advantages of the present invention will be set forth in and apparent from the description that follows. Additional advantages of the invention will be realized and attained by the methods and systems particularly pointed out in the written description and claims hereof, as well as from the appended drawings.

To achieve these and other advantages and in accordance with the purpose of the invention, as embodied, the invention includes, in one aspect, a system for adjusting a compression ratio of an internal combustion engine, the system including one or more pistons disposed in an upper portion of the engine block, the pistons being connected to a crankshaft by respective connecting rods, and the crankshaft being carried by an engine block, a piston position adjusting mechanism provided in connection with each of the pistons, a trigger for actuating each piston position adjusting mechanism, and a control for actuating the trigger.

The piston position adjusting mechanism includes a lever pivotably mounted on each of the connecting rods, adapted and configured to pivot when actuated, a cam, rotatably mounted with respect to each of the pistons and respective connecting rods, adapted and configured to maintain, at any moment, one of a plurality of spacings therebetween, rotation of the cam by a preselected angle causing a change in relative spacing between the head of the respective piston and small end of the connecting rod. The trigger is adapted and configured to cause pivoting of the lever, engagement between the cam and the lever, and rotation of the cam by the preselected angle. The lever can be resiliently biased against the connecting rod, such as by a spring, for example.

The system can further include a ratchet gear and pawl interposed between the lever and the cam, the pawl carried by the lever and the ratchet gear provided in rotationally-fixed position with respect to the cam, pivoting of the lever causing urging of the ratchet gear by the pawl, resulting in rotation of the cam by the preselected angle. The pawl can be resiliently biased in an extended position, in which the pawl engages a tooth of the ratchet gear. The pawl can include a pivotable member, permitting deflection of the pawl during return of the lever to a resting position with respect to the connecting rod.

The piston position adjusting mechanism can be adapted and configured such that the cam includes a plurality of angularly offset surfaces, adapted and configured for abutting a cam surface defined on the piston. The angularly offset surfaces can be substantially planar in configuration. Alternatively, the angularly offset surfaces can be substantially arcuate in configuration.

The cam can be rotationally symmetric, permitting unidirectional rotation of the cam for transitioning between selected compression ratios, determined based on the relative spacing between the head of the respective piston and small end of the connecting rod.

The cam can be adapted and configured to maintain one of two spacings between each piston and its respective connecting rod, depending on a rotational orientation of the cam with respect to the cam surface of the piston.

Each cam can include one or more spacer blocks and a piston pin connecting the spacer blocks. The piston pin can be provided such that it passes through a small end of the connecting rod. The spacer blocks can be spaced apart from one another to permit maximum separation between the blocks within the cylinder bore, to promote stability of the piston, with respect to its respective connecting rod.

The system can further include one or more guides adapted and configured to slide linearly with respect to the piston and bore, the cam and the piston being mutually connected by way of the one or more guides. Each of the one or more guides can be resiliently connected to the piston by one or more springs, and is urged axially in contact with the piston.

Each of the one or more guides can be resiliently connected to the piston by way of a spring engaged with the piston and exerting force on a piston pin, engaged with each of the one or more guides.

The engine block can be a split block, having a main block and a bedplate. The trigger can be provided in connection with the bedplate. The trigger can be housed in a cavity formed in the bedplate.

The trigger can be adapted to momentarily move into a position in which a portion of the trigger enters a path of the lever, causing the lever to pivot with respect to the connecting rod. The trigger can include a protrusion extending into a path of the lever.

The trigger can be resiliently biased away from the path of the lever and hydraulically actuatable into the path of the lever. This can be accomplished by way of a spring, such as by a coil spring, for example.

The control can include a hydraulic circuit adapted and configured to supply high hydraulic fluid to the trigger, at a pressure sufficient to urge the trigger into the path of the lever, against the biasing force.

The trigger can be held within a trigger bore of a housing, configured such that when actuated, hydraulic fluid fills the trigger bore on a side of the trigger opposite a direction from which the lever strikes the trigger, the hydraulic fluid serving to dampen impact between the lever and the trigger.

The control can be provided in connection with an engine management system, provided in connection with the internal combustion engine, the engine management system determining when to actuate each trigger to adjust a compression ratio of each piston, respectively.

In accordance with a further aspect of the invention, a method of adjusting a compression ratio of an internal combustion engine is provided, the method comprising the steps of: providing an internal combustion engine having one or more pistons disposed in an upper portion of the engine block, the pistons being connected to a crankshaft by respective connecting rods, the crankshaft being carried by an engine block, providing a piston position adjusting mechanism including an adjustable cam between a connecting rod and a piston bearing surface, selecting a point during an operation cycle of the internal combustion engine to change a compression ratio thereof, and triggering the piston position adjusting mechanism to change a relative spacing between the head of the respective piston and small end of the connecting rod. The cam can be adjustable by way of being configured to rotatably permit adjustability.

It is to be understood that both the foregoing general description and the following detailed description are exemplary and are intended to provide further explanation of the invention claimed.

BRIEF DESCRIPTION OF THE DRAWINGS

The accompanying drawings, which are incorporated in and constitute part of this specification, are included to illustrate and provide a further understanding of the method and system of the invention. Together with the description, the drawings serve to explain the principles of the invention, wherein.

DETAILED DESCRIPTION

Reference will now be made in detail to the present preferred embodiments of the invention, an example of which is illustrated in the accompanying drawings. The method and corresponding steps of the invention will be described in conjunction with the detailed description of the system.

The present invention is directed to a system, and the related method, that varies the compression ratio by permitting shifting of at least the top dead center piston position, and optionally both the top dead center and bottom dead center positions of the engine pistons upward, with respect to the cylinder bore, thereby proportionately increasing the compression ratio of the engine. Depending on the precise implementation, the timing of the piston position adjustment can be selected during an appropriate stroke of the engine cycle. In a four-stroke internal combustion engine, for example, a compression ratio can be increased or decreased by moving the piston upward or downward, respectively, with respect to the connecting rod, during a physically advantageous point in the engine cycle. For example, the piston can be moved upward or downward at the beginning of the exhaust stroke, typically following the power stroke. Alternatively, the piston can be moved upward or downward at the beginning of the compression stroke, typically following the intake stroke. Alternatively still, actuation of the piston adjusting mechanism to adjust compression ratio, can occur during or alternatively following a deactivated stroke, such as when used in conjunction with cylinder deactivation engine management systems, for example. Piston inertia can be used to reduce force needed to move the piston 140 with respect to the connecting rod 153.

Figure 1:
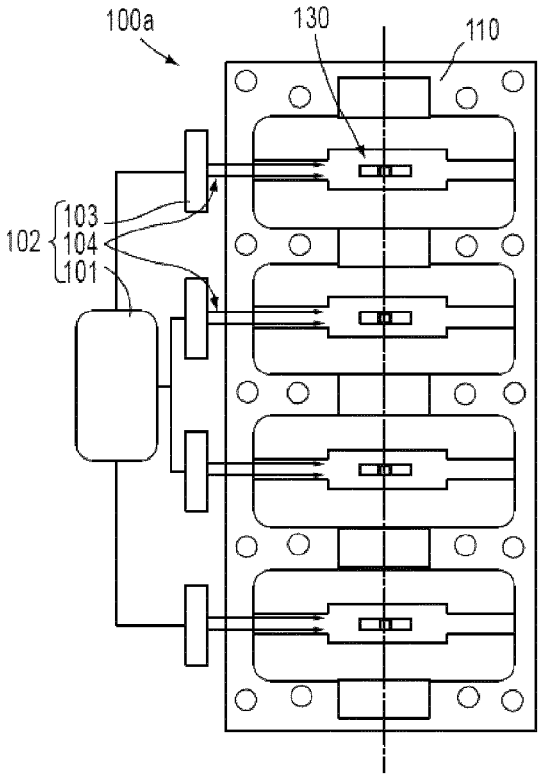
FIG. 1 is a top partial view of a variable compression ratio system for internal combustion engines, in accordance with one aspect of the present invention, illustrating an engine bedplate and control components of the system.
Figure 2:
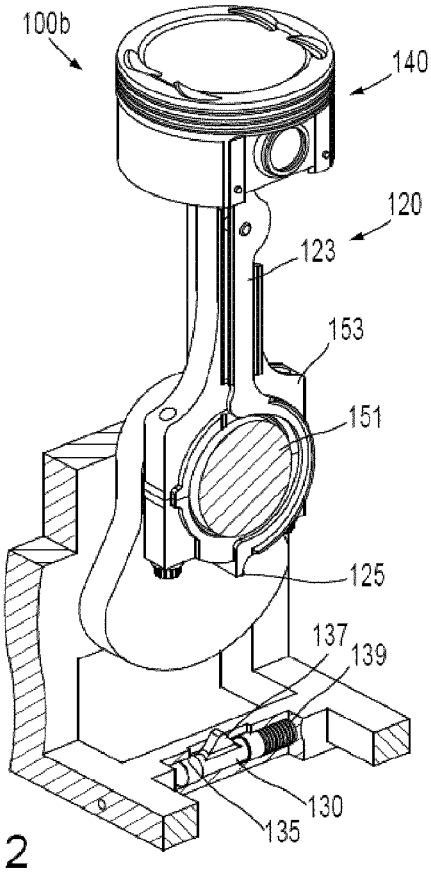
FIG. 2 is an isometric view of a variable compression ratio system for internal combustion engines, in accordance with one aspect of the present invention, illustrating an engine piston and piston position adjusting mechanism of the system.

FIGS. 1 and 2, jointly illustrate components of a variable compression ratio system 100 (100*a*, 100*b*) for internal combustion engines, in accordance with one aspect of the present invention, where FIG. 1 is a top partial view of an engine bedplate 110 and control components of the system 100, including a control unit 101, and valves 103. The compression ratio adjustment can be integrated into an engine control unit ("ECU"). Alternatively, a separate control unit from engine management control can be provided. FIG. 2 is an isometric view illustrating an engine piston 140 and piston position adjusting mechanism 120 of the system 100.

With reference to all figures, but firstly to FIGS. 1 and 2, in accordance with the invention, a system 100 for adjusting a compression ratio of an internal combustion engine, includes one or more pistons 140 disposed in an upper portion (not illustrated) of the engine block, the pistons 140 being connected to a crankshaft 151 by respective connecting rods 153, and the crankshaft 151 being carried by an engine block, which can be a unitary structure, or a multi-part structure, such as one including an upper portion and a bedplate 110, for example. A piston position adjusting mechanism 120 is provided in connection with each of the pistons 140. A trigger 130 for actuating each piston position adjusting mechanism 120, and a control 102 for actuating the trigger 130.

The block and cylinder heads are generally of a conventional configuration, although the height thereof may be increased to permit increased range of the pistons, which depends on the selected compression ratio.

In accordance with a preferred aspect of the invention, the piston position adjusting mechanism 120 includes a lever 123 pivotably mounted on each of the connecting rods 153. A pin 129*a* on the connecting rod 153, and corresponding apertures 129*b* (FIG. 5) in the lever 123 comprise the pivot 129, in the illustrated embodiment, although other configurations are possible. The lever 123 is adapted and configured to rotate about the pivot 129 when actuated by the trigger 130. The lever 123 causes a cam 122 (FIGS. 12, 13*a*, 13*b*, and 15-17), rotatably mounted with respect to each of the pistons 140 and respective connecting rods 153, adapted and configured to maintain, at any moment, one of a plurality of spacings therebetween. In accordance with one aspect of the invention, the system 100 is adapted and configured to provide two possible compression ratios. In accordance with one aspect, the difference in the position of a piston 140 between one ratio position and that of the second compression ratio is about 3.5 millimeters, as measured from a fixed position in the travel of the connecting rod 153, for example, such as a bottom dead center.

Figure 3:
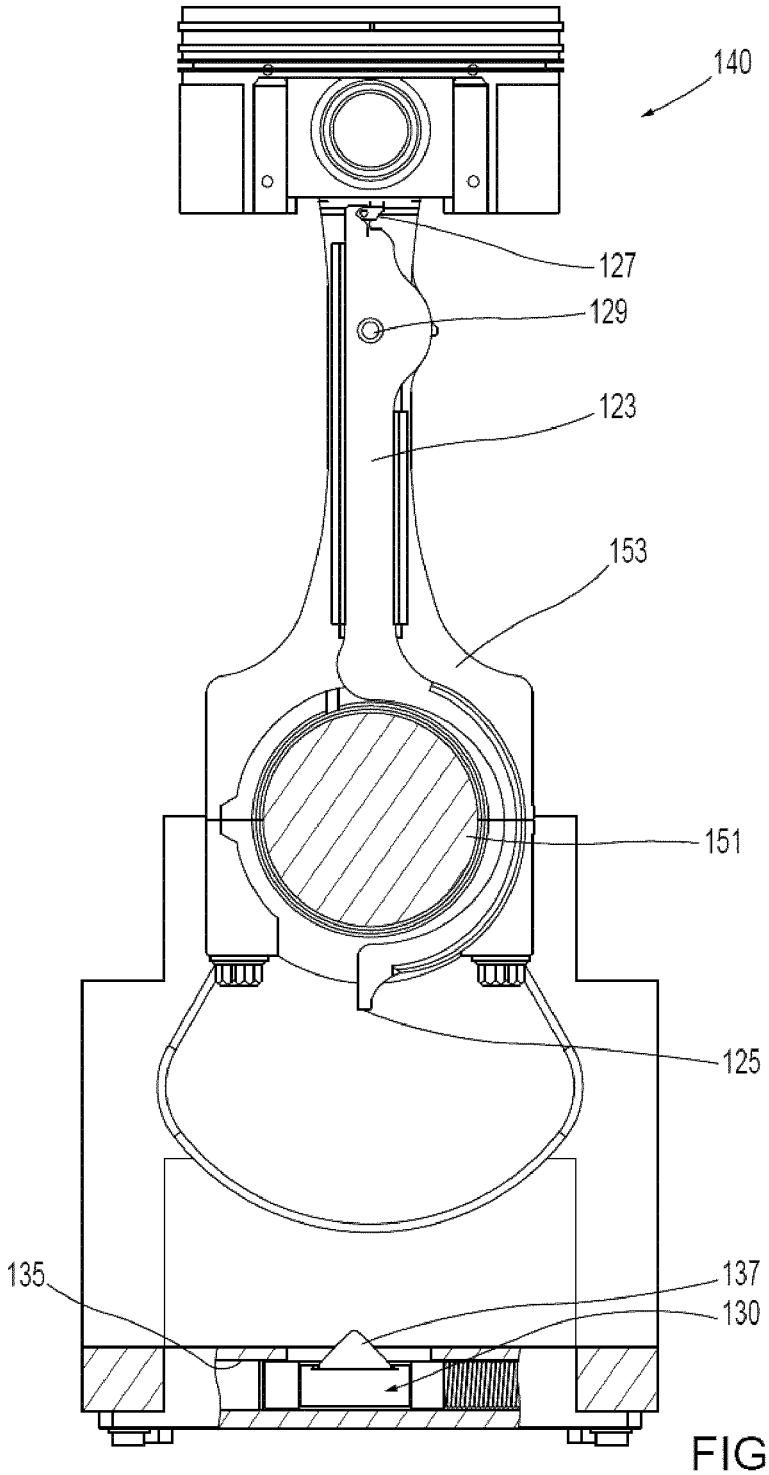
FIG. 3 is a front view of the engine piston and piston position adjusting mechanism of FIG. 2.
Figure 4:
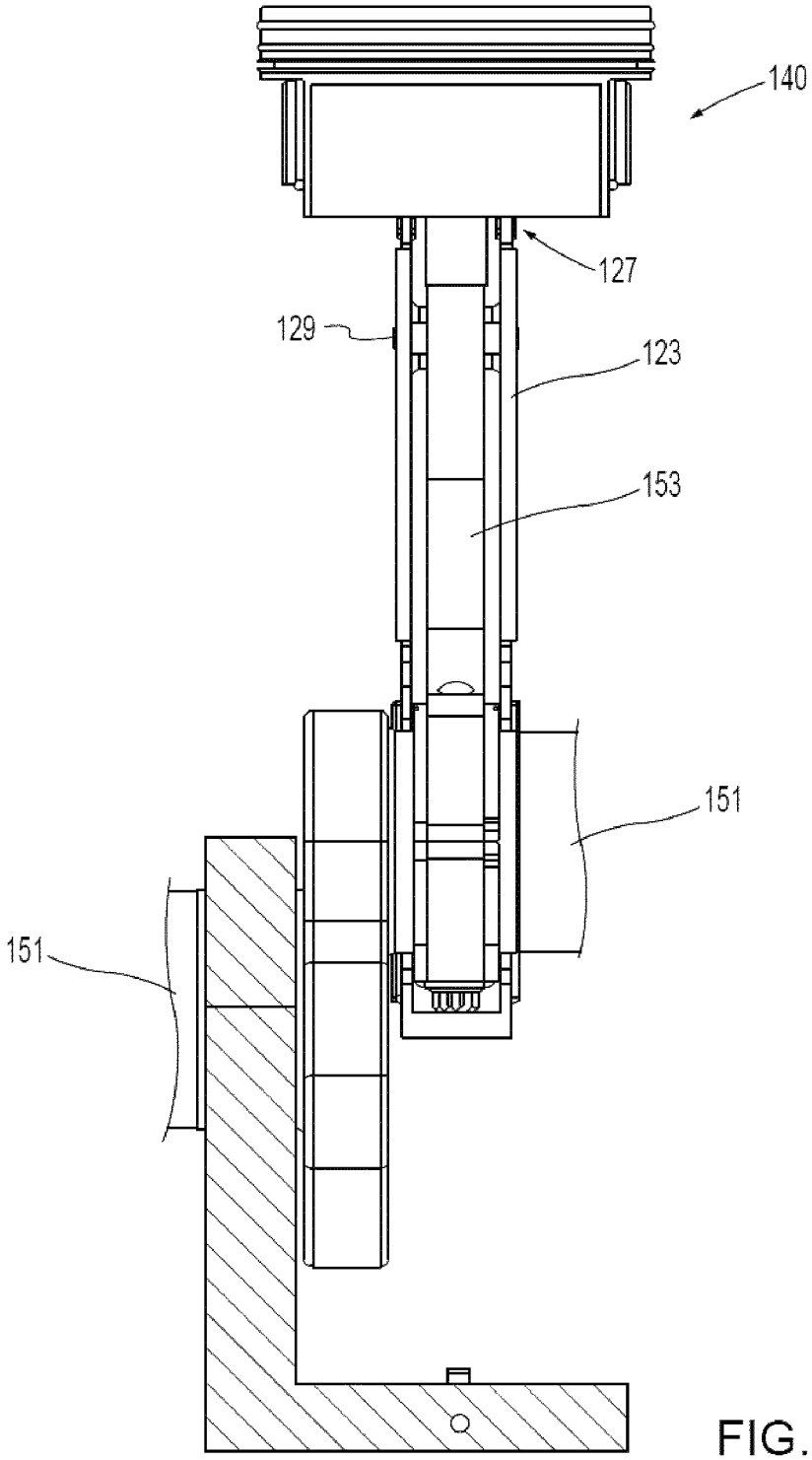
FIG. 4 is a side view of the engine piston and piston position adjusting mechanism of FIG. 2.
Figure 5:
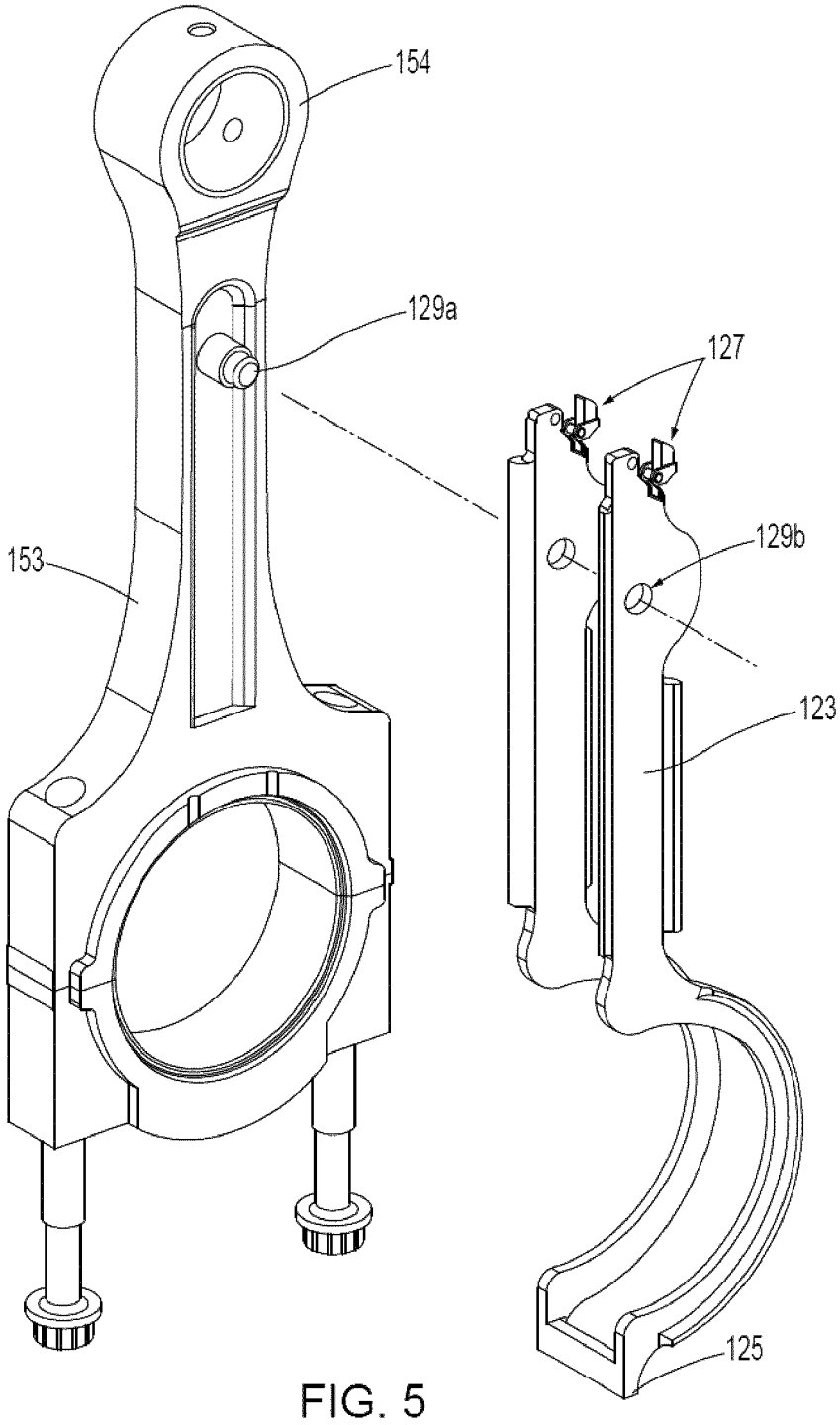
FIG. 5 is an exploded isometric view of a connecting rod and portion of the piston position adjusting mechanism of FIG. 2.

As best seen in FIGS. 2, 3 and 5, for example, the lever 123 includes an arcuate lower end, as it extends around the crankshaft and the big (lower) end of the connecting rod 153. The lever 123 is preferably balanced with respect to the pivot 129.

Figure 12:
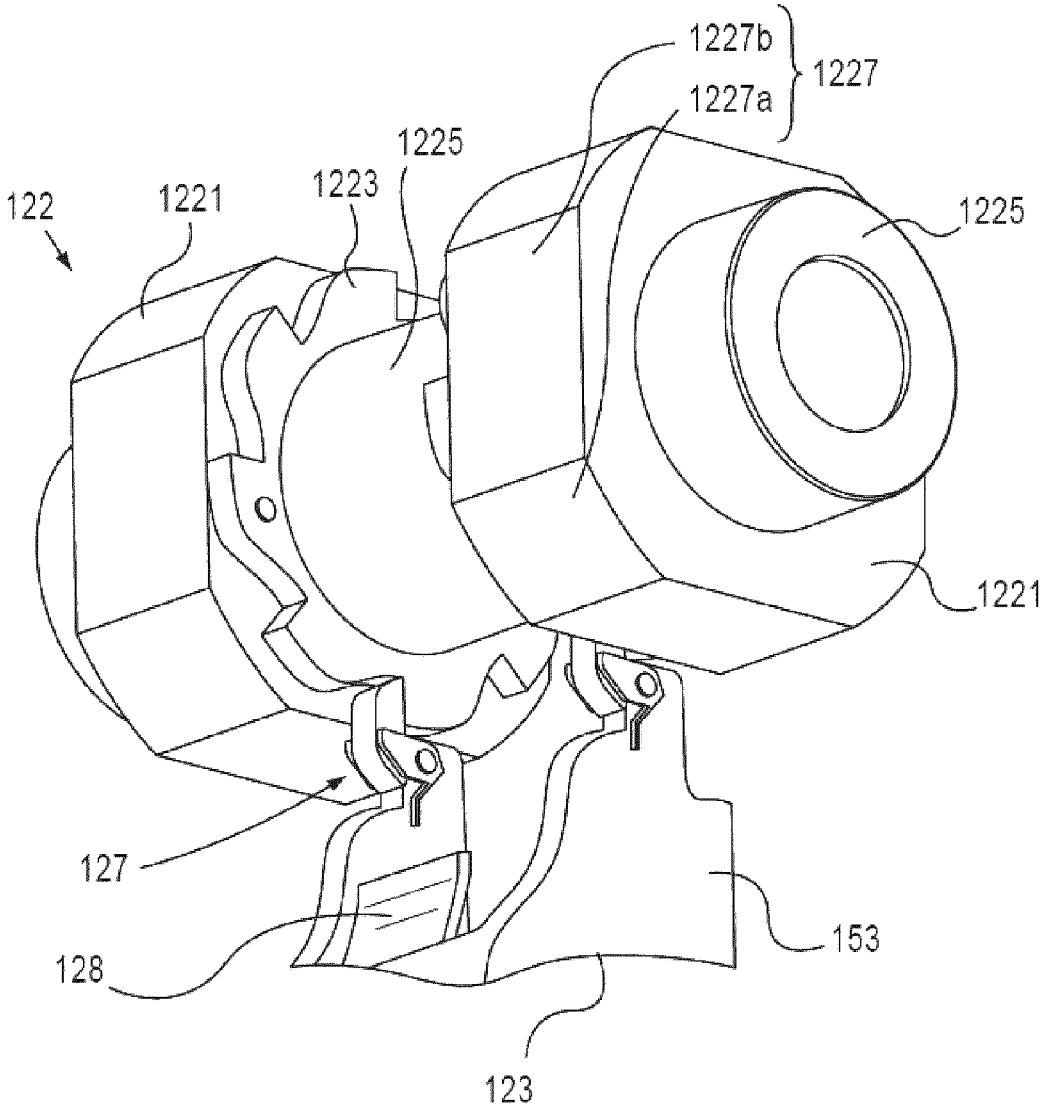
FIG. 12 is a partial isometric view of an upper portion of the piston position adjusting mechanism, illustrating an upper portion of the lever, pawls and cooperating ratchet gear, associated with a cam thereof.
Figure 13A:
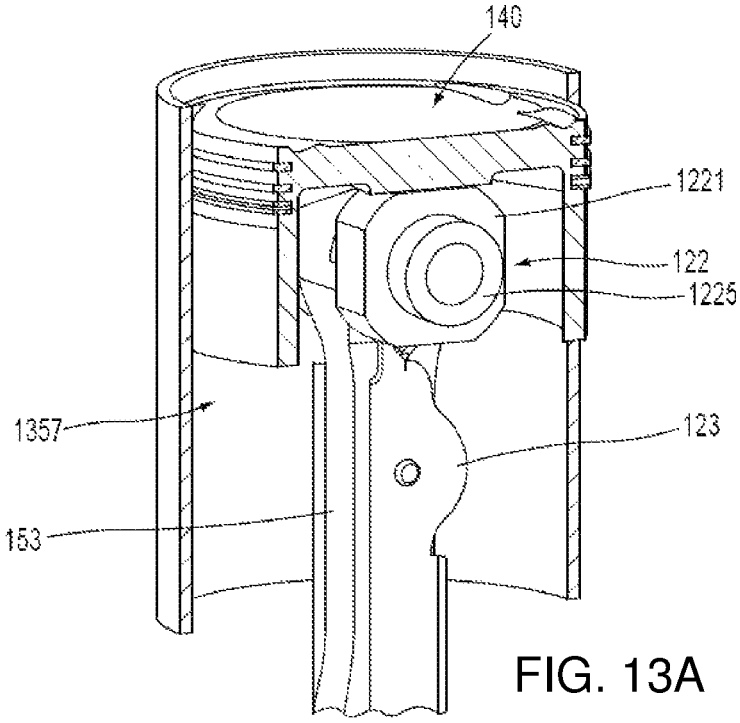
FIG. 13A is a partial cutaway isometric view of a piston and piston position adjusting mechanism, illustrating a cam portion thereof positioned to maintain a first compression ratio of the engine.
Figure 13B:
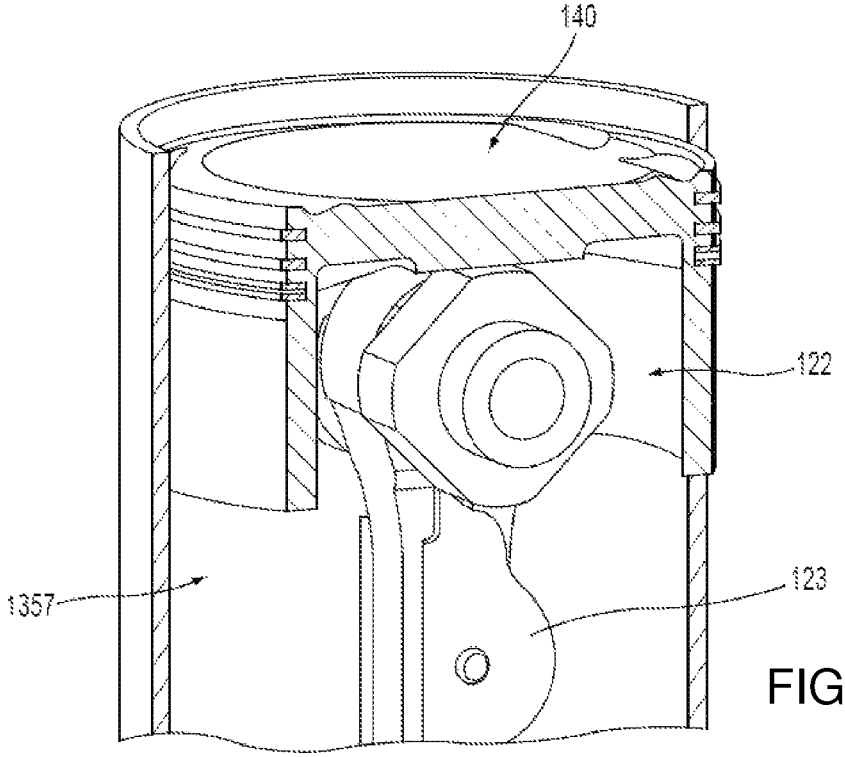
FIG. 13B is a partial cutaway isometric view of a piston and piston position adjusting mechanism, illustrating a cam portion thereof positioned to maintain a second compression ratio of the engine.
Figure 14:
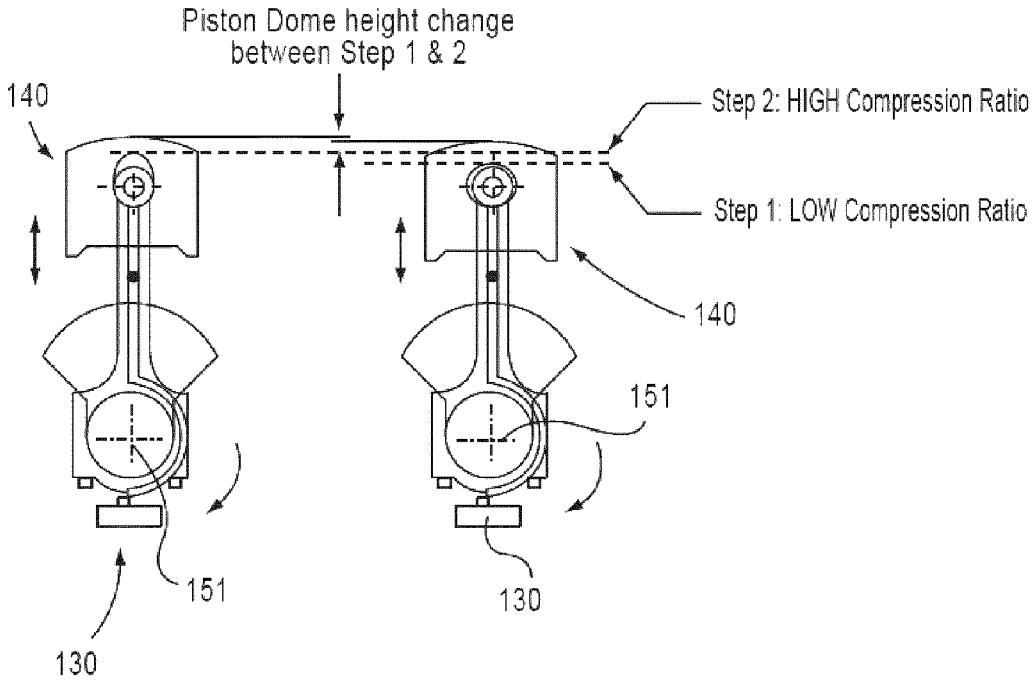
FIG. 14 is a schematic side view illustrating a change in piston position between associated combustion ratios in accordance with the invention.

As illustrated, for example in FIGS. 13A and 13B, rotation of the cam 122 by a preselected angle causes a change in relative spacing between the respective piston 140 and connecting rod 153. In the illustrated embodiment, the cam 122 is rotationally symmetric and bearing surfaces 1127*a*, 1127*b*, with their respective diametrically opposed bearing surfaces permit, with incremental rotational movement of the cam 122, cyclical toggling between compression ratios. In the illustrated embodiment, incremental rotation of the cam 122 by increments of 45 degrees effects toggling between compression ratios. In the illustrated embodiment, as shown in FIG. 12, for example, bearing surface 1227*a* is diametrically further from its opposed bearing surface than 1227*b*. In accordance with one preferred embodiment, the difference in spacing is about 3.5 millimeters, to effect a change in piston 140 position of about 3.5 millimeters between the two selected compression ratios. It is to be understood, however, that the difference in positioning and thus compression ratios is based on engine displacement and other factors such as fuel type (e.g., gasoline (petrol), diesel fuel oil).

Figure 6:
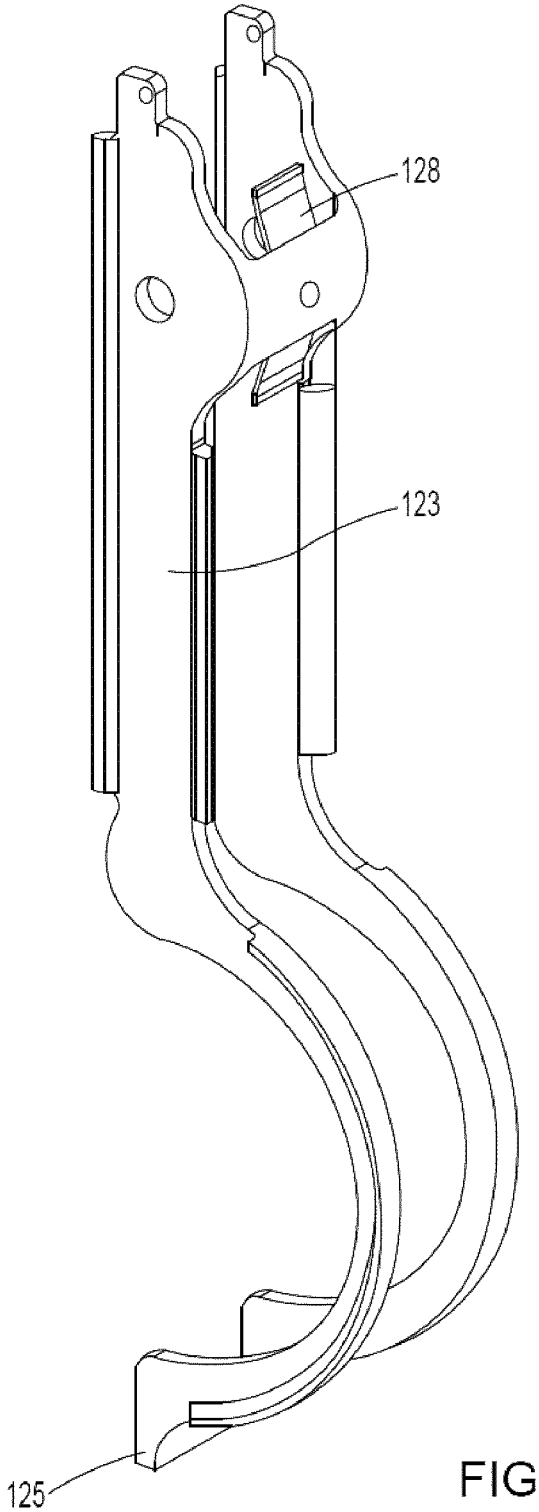
FIG. 6 is an isometric view of a lever portion of the piston position adjusting mechanism of FIG. 2.
Figure 7:
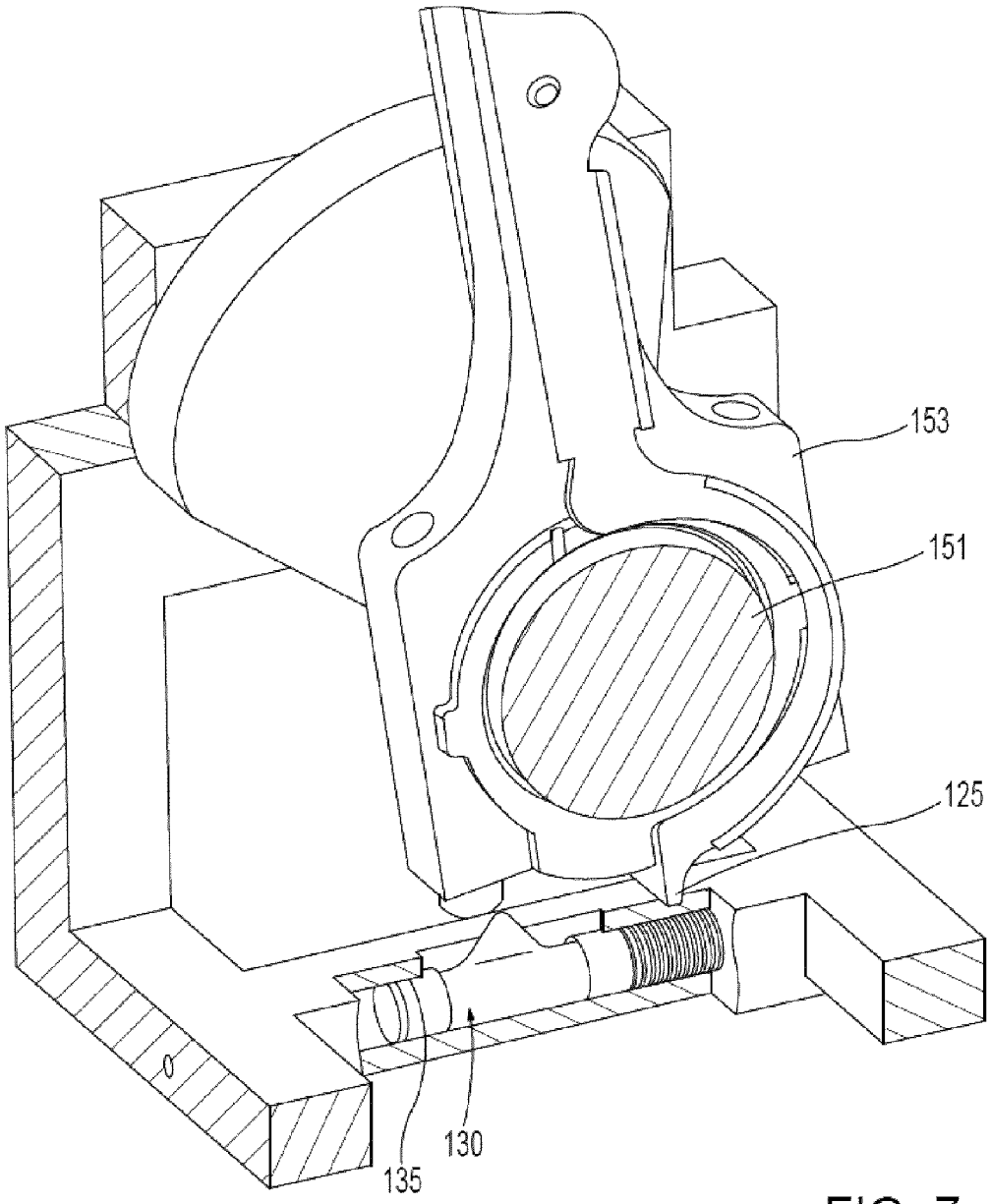
FIG. 7 is a partial isometric view of a lower end of the piston position adjusting mechanism of FIG. 2, and partial cutaway view of a trigger for actuating the piston position adjusting mechanism, in accordance with the invention, wherein the lever of the piston position adjusting mechanism is positioned to strike the trigger, to actuate the piston position adjusting mechanism.

The trigger 130 is adapted and configured to cause pivoting of the lever 123, engagement between the cam 122 and the lever 123, and rotation of the cam 122 by the preselected angle. The lever 123 can be resiliently biased against the connecting rod 153, such as by a spring 128 (FIG. 6), for example. The spring 128 can be a flat spring, or alternatively another type of spring or resilient biasing member.

Figure 11:
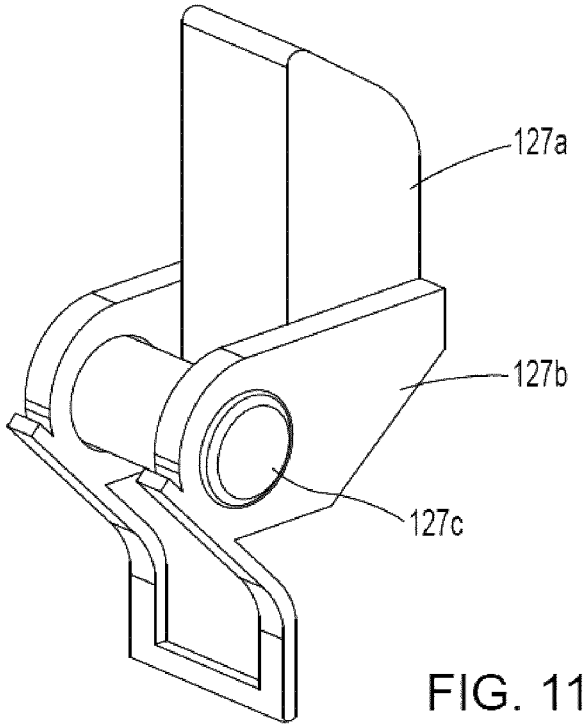
FIG. 11 is an enlarged isometric view of the pawl of the piston position adjusting mechanism.

As best illustrated in FIG. 12, the system 100 can further include a ratchet gear 1223 and pawl 127 interposed between the lever 123 and the cam 122. The pawl 127 is, as illustrated, carried by the lever 123 and the ratchet gear 1223 is provided in rotationally-fixed position with respect to the other components of the cam 122. Pivoting of the lever 123 urges the ratchet gear 1223 by the pawl 127, resulting in rotation of the cam 122 by the preselected angle. As illustrated in FIG. 12, each segment of the ratchet gear 1223 corresponds to a rotation of about 45 degrees, corresponding to the configuration of the bearing surface 1227 (1227*a*, 1227*b*) of the cam 122. The pawl 127 can be resiliently biased in an extended position, in which the pawl 127 engages a tooth of the ratchet gear 1223. As illustrated in FIG. 11, the pawl 127 can include a pivotable tooth 127*a*, a support 127*b* that can be integral with a spring element, and a pivot pin 127*c*, permitting deflection of the pawl 127 during return of the lever 123 to a resting position with respect to the connecting rod 153.

As mentioned above, the piston position adjusting mechanism 120 can be adapted and configured such that the cam 122 includes a plurality of angularly offset surfaces 1227*a*, 1227*b*, which are adapted and configured for abutting a cam surface 147 (FIG. 15) defined on the piston 140. The angularly offset surfaces 1227 can be substantially planar in configuration. Alternatively, the angularly offset surfaces 1227 can be substantially arcuate in configuration.

As illustrated, the cam 122 can be adapted and configured to maintain one of two spacings between each piston 140 and its respective connecting rod 153, depending on a rotational orientation of the cam 122 with respect to the cam surface 147 of the piston 140. Alternatively, additional configurations are possible in accordance with the invention, including different shaped cam spacer blocks 1221. For example, the illustrated spacer blocks 1221 are generally octagonal in cross-section. However, the spacer blocks 1221 can alternatively have additional bearing surfaces 1227, such as 16, permitting a three-step compression ratio configuration, with a corresponding number and arrangement of ratchet gear teeth. Alternatively still, the spacer blocks 1221 can be shaped having a continuous curve, such as an ellipse, with maximum and minimum axes, and any number and arrangement of ratchet gear teeth, but preferably being regularly angularly spaced apart.

As best seen in FIG. 12, each cam 122 can include a plurality of spacer blocks 1221 and a piston pin 1225 connecting the spacer blocks 1221. The piston pin 1225 can be provided such that it passes through a small end 154 (FIG. 5) of the connecting rod 153. The spacer blocks 1221 can be spaced apart from one another to permit maximum separation between the blocks 1221 within the cylinder bore 1357 (FIGS. 13A, 13B), to promote stability of the piston 140, with respect to its respective connecting rod 153.

Figure 15:
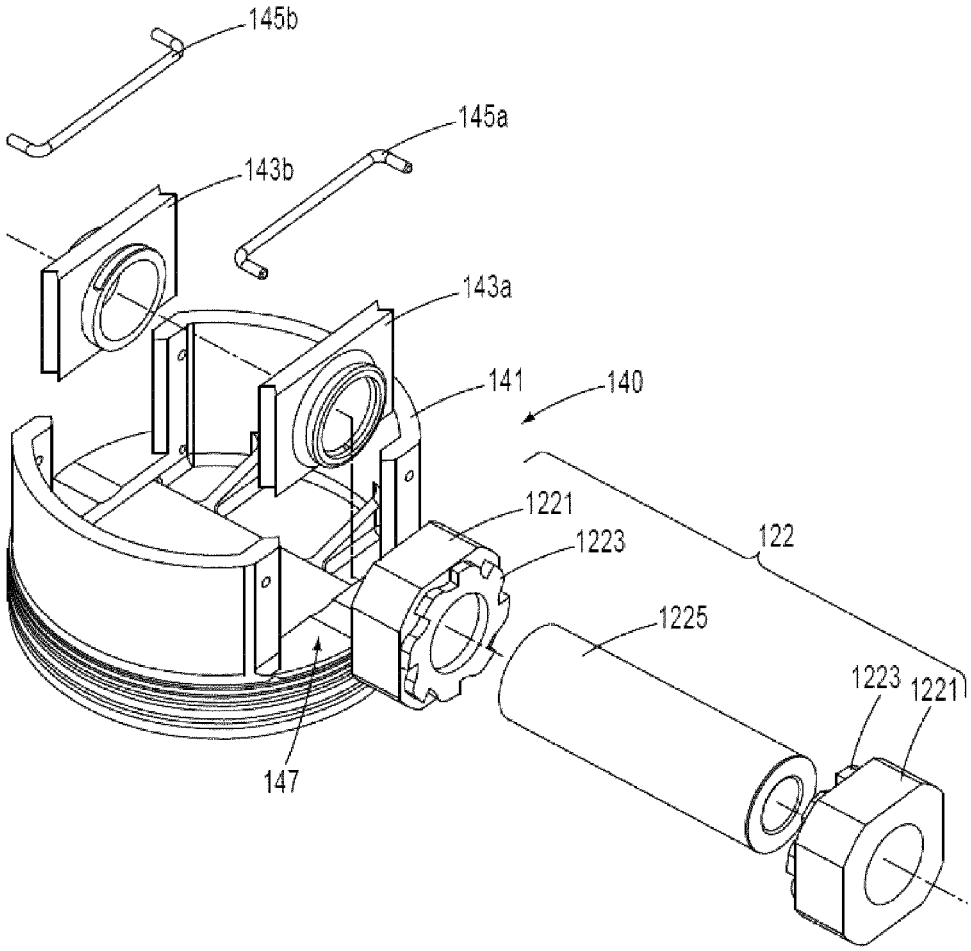
FIG. 15 is an exploded isometric view, illustrating a lower surface of a piston and cam portion of a piston position adjusting mechanism in accordance with the invention.
Figure 16:
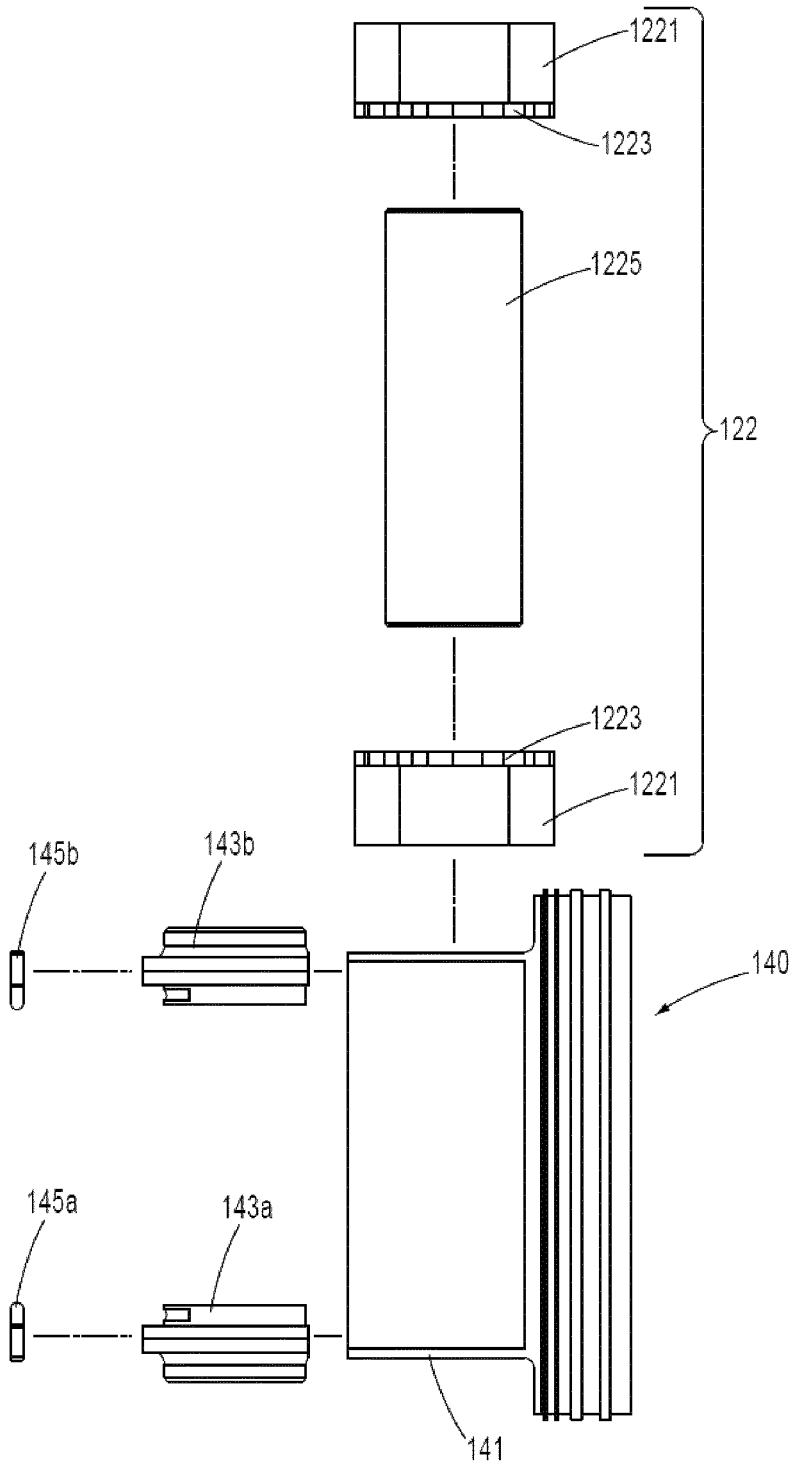
FIG. 16 is an exploded side view of a piston and cam portion of a piston position adjusting mechanism in accordance with the invention.
Figure 17:
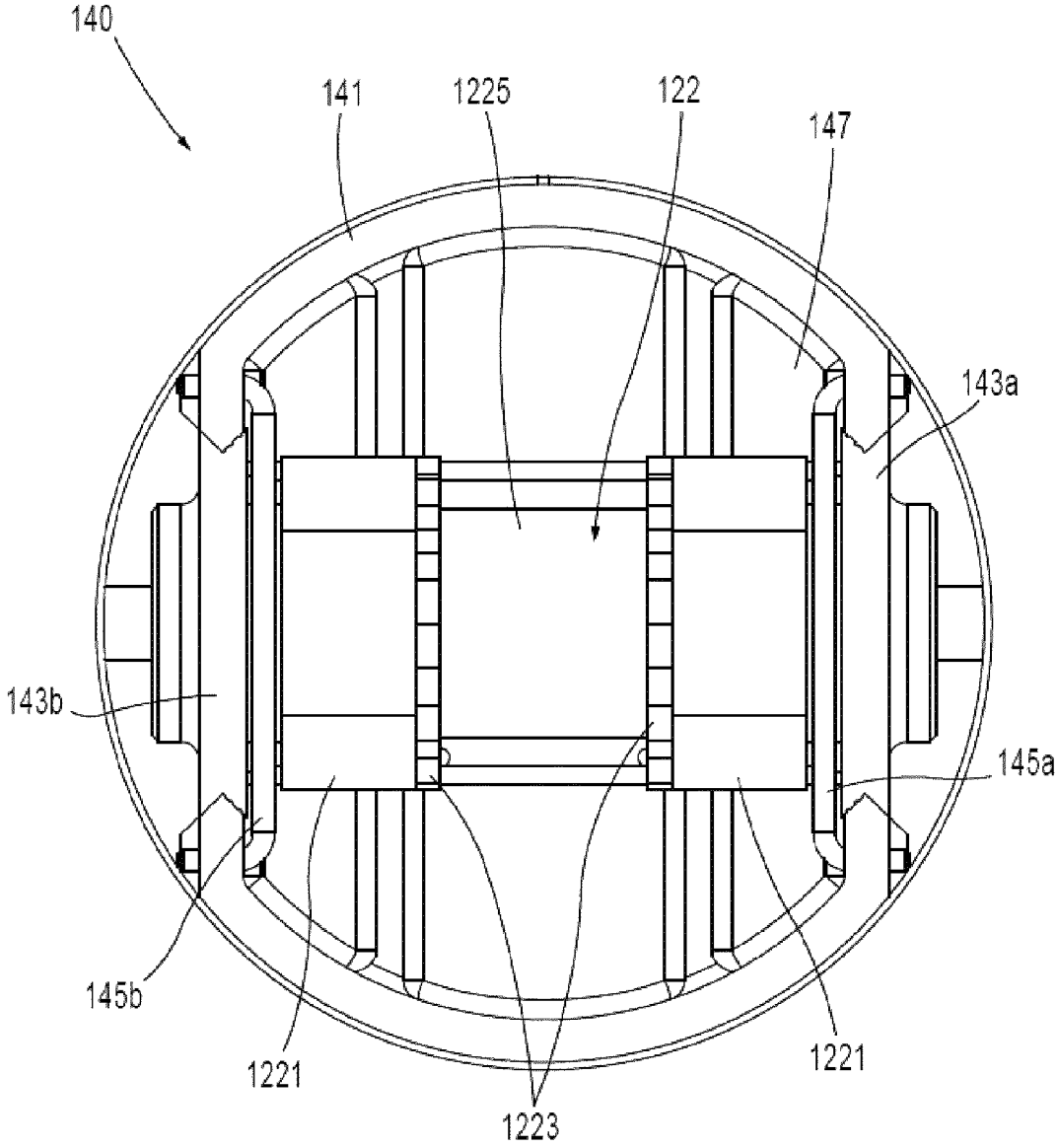
FIG. 17 is a bottom view of a lower surface of a piston and cam portion of a piston position adjusting mechanism in accordance with the invention.

As best seen in FIGS. 15-17, the system 100 can further include one or more sliding guides 143*a*, 143*b* constituting a pin carrier, adapted and configured to slide linearly with respect to the piston 140 and bore 1357. The cam 122 and the piston 140 thus being mutually connected by way of the guides 143*a*, 143*b*. As illustrated, a concave inner contour, in this case, V-shaped grooves, are formed on opposing edges of each of the guides 143*a*, 143*b*, with corresponding contours being provided on the interfacing edges of the piston body 141, permitting only substantial linear translation of the guides 143*a*, 143*b*. Each of the guides 143*a*, 143*b* can be resiliently connected to the piston by one or more springs 145*a*, 145*b*, and is urged axially in contact with the piston 140. Each of the guides 143*a*, 143*b* can be resiliently connected to the piston body 141 by way of a respective spring 145*a*, 145*b* engaged with the piston body 141, exerting force on a piston pin 1225, which is engaged with each of the one or more guides 143*a*, 143*b*. As illustrated, the wire springs 145*a*, 145*b* provide sufficient force to maintain translation of the guides 143*a*, 143*b*, relative to the skirt and crown of the piston 140 within acceptable limits. It is conceived that variations of the illustrated sliding guides 143*a*, 143*b* are possible.

Figure 18:
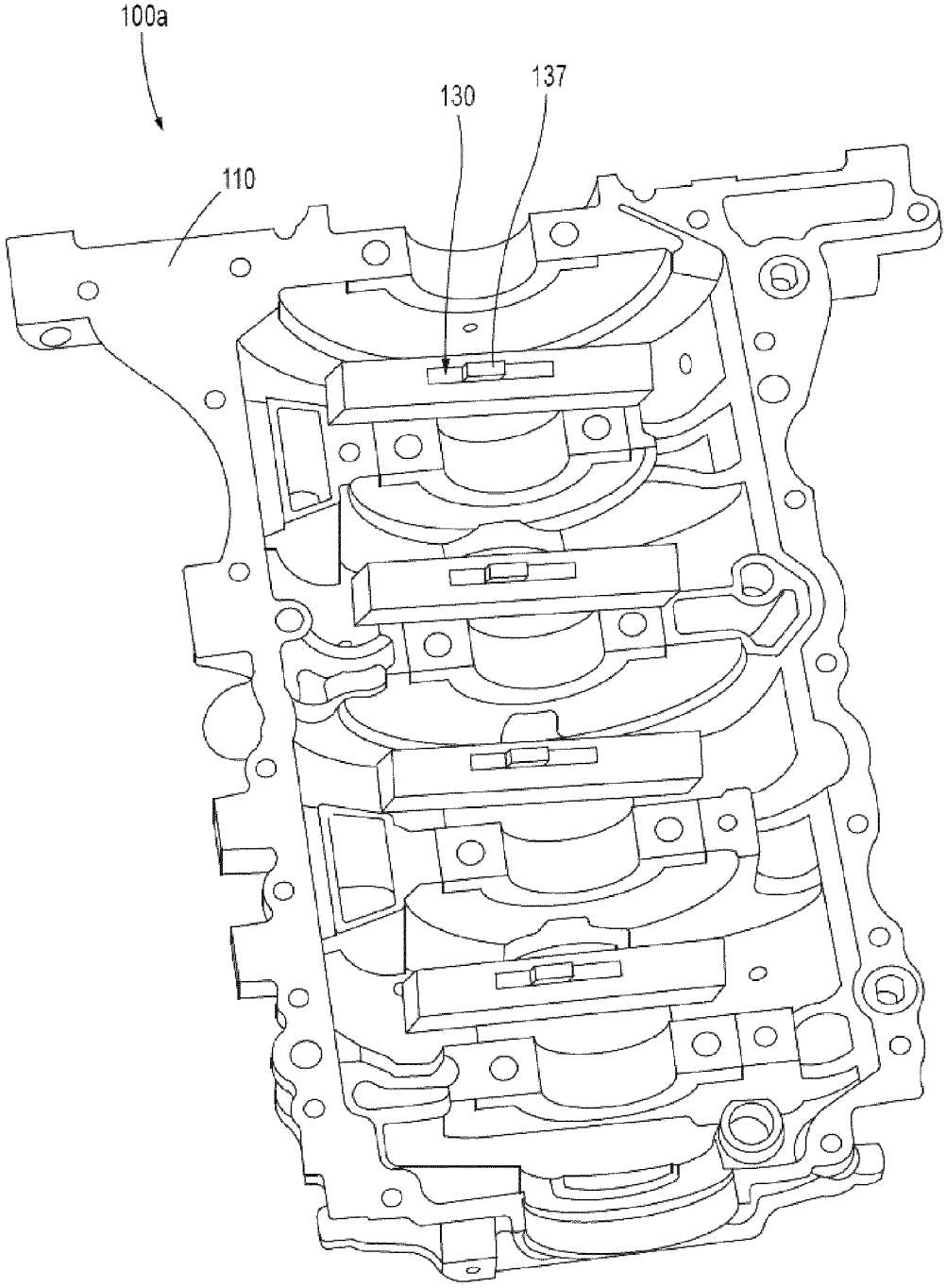
FIG. 18 is an isometric view of an engine bedplate, with integrated triggers provided therewith.
Figure 19:
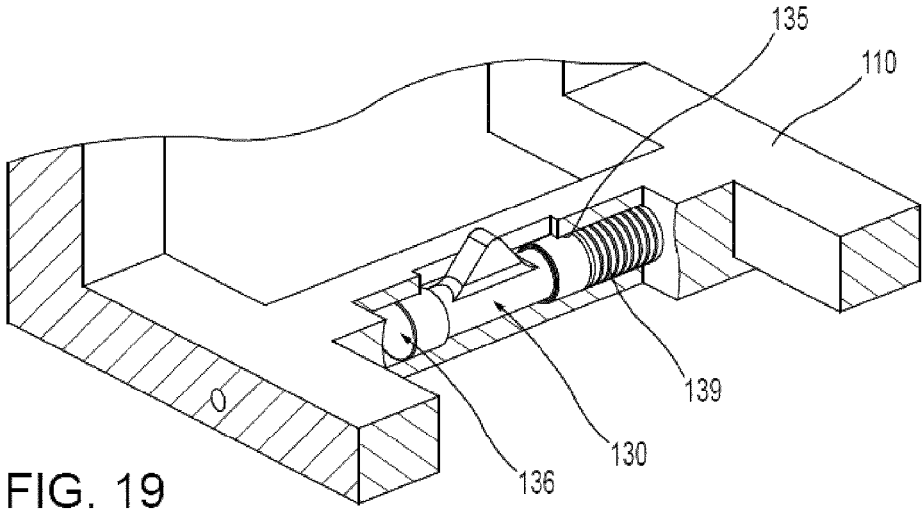
FIG. 19 is an isometric partial cutaway view of an example mounting region of an engine, illustrating a trigger provided therein, of the piston position adjusting mechanism in accordance with the invention.
Figure 20:
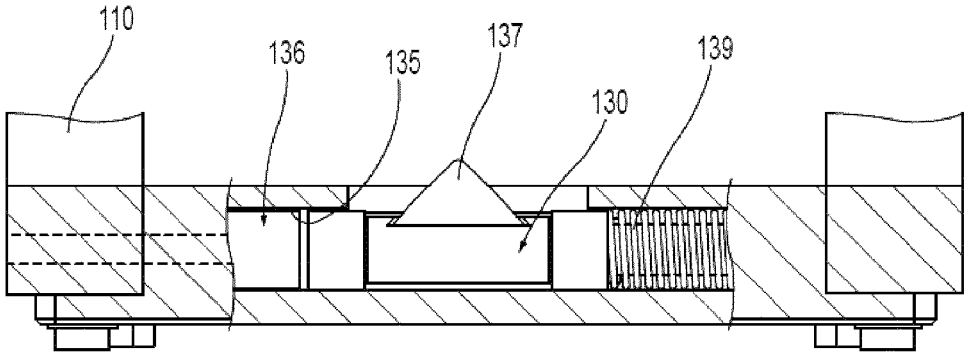
FIG. 20 is an side partial cutaway view of an example mounting region of an engine, illustrating the trigger provided therein, in accordance with the invention.
Figure 21:
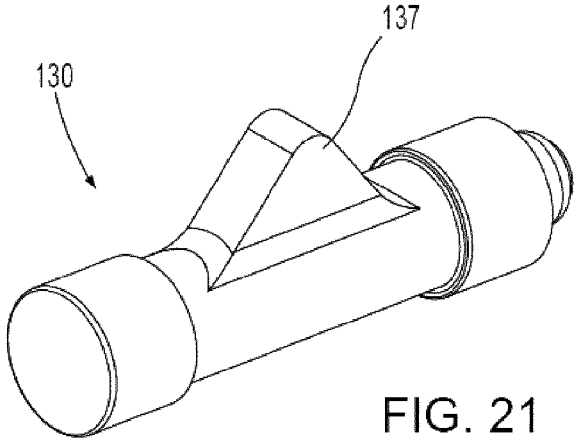
FIG. 21 is an isometric view of a moveable portion of the trigger of the piston position adjusting mechanism in accordance with the invention.

As mentioned above, the engine block can be a split block, having a main block and a bedplate 110. As best seen in FIGS. 1 and 18, the triggers 130 can be provided in connection with the bedplate 110. The triggers 130 can be housed in respective cavities formed in the bedplate 110.

Figure 8A:
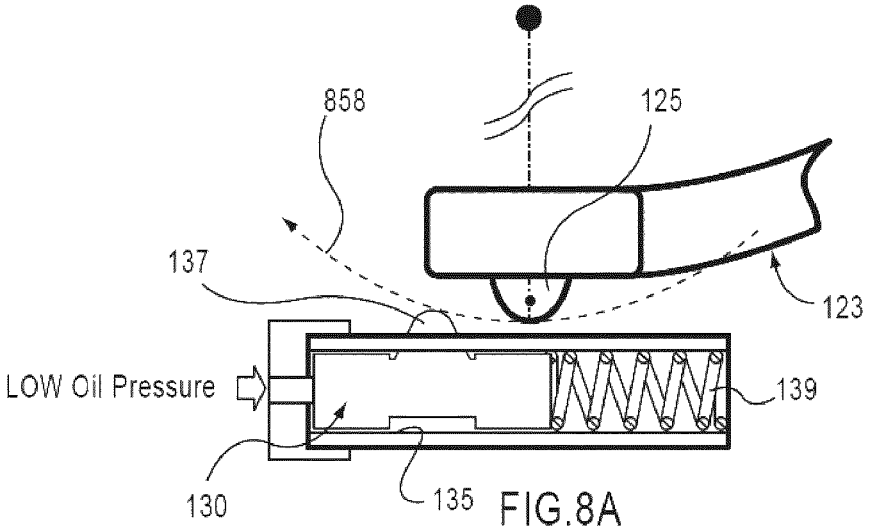
FIG. 8A is a schematic side view illustrating a lower portion of the lever of the piston position adjusting mechanism, traveling along a curved path, wherein the trigger is positioned outside of the path.
Figure 8B:
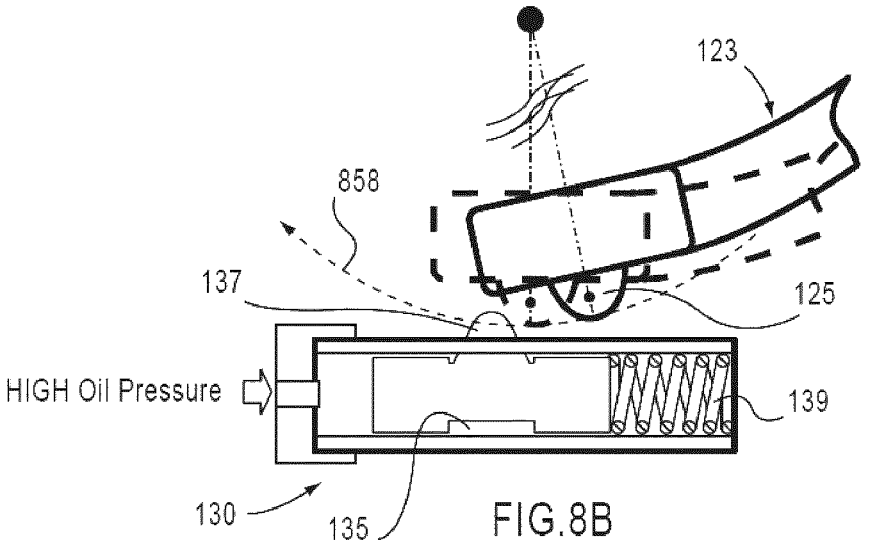
FIG. 8B is a schematic side view illustrating a lower portion of the lever of the piston position adjusting mechanism, traveling along a curved path, wherein the trigger is positioned within the path, the lever being poised to strike the trigger and thus actuate the piston position adjusting mechanism.
Figure 9:
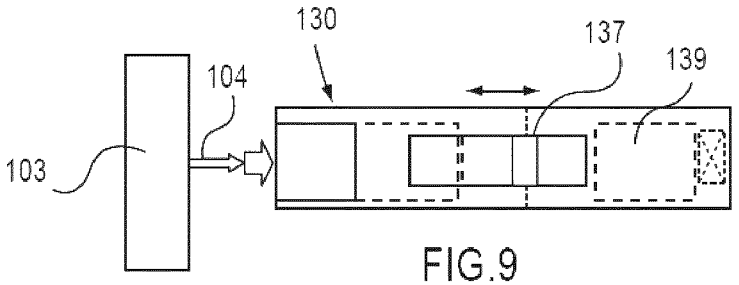
FIG. 9 is a top schematic view of the trigger of the preceding figures, also illustrating a controlling valve associated with the trigger.
Figure 10:
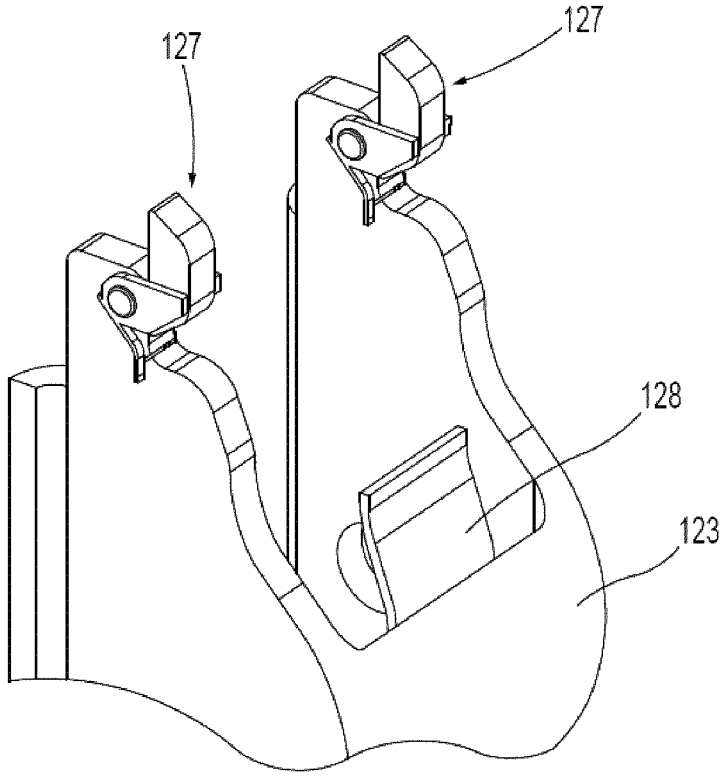
FIG. 10 is a partial isometric view of an upper end of the lever portion of the piston position adjusting mechanism, illustrating a pawl portion thereof and a return spring therefor.

With particular reference to FIGS. 8A and 8B, the trigger 130 can be adapted to momentarily move into a position (FIG. 8B) in which the trigger is actuated to place a striker 137 thereof into the path 858 of the lever 123, causing a protrusion 125 of the lever 123 to hit the striker, and the lever 123 to pivot with respect to the connecting rod 153. The trigger 130 is preferably resiliently biased away from the path 858 of the lever 123 and hydraulically actuatable into the path 858. As illustrated this resilient bias is accomplished by way of a coil spring 139.

The subject variable compression ratio systems can be controlled by way of a dedicated control unit, or by way of control hardware and program code integrated into an engine control system 101 (FIG. 1). As such, the control 102 can be pre-programmed with a map of engine loads and performance characteristics, which determine at what moment, and under what set of operating parameters compression ratio can be altered. Such parameters can include throttle position, manifold absolute pressure, engine speed and/or engine operating temperature, for example.

The control 102 can include a hydraulic circuit 104 adapted and configured to supply high hydraulic fluid to the triggers 130, at a pressure sufficient to urge the triggers 130 into the path 858 of the respective protrusions 125 of the levers 123, against the biasing force of the respective springs 139. Alternatively, or additionally, the triggers 130 can be operated by mechanical linkages from components placed outside of the engine block and/or be electromagnetically actuated. Control valves 103 receive a signal from the control unit 101 and open to permit flow of the fluid into the triggers.

In the illustrated embodiment, each trigger 130 is held within a respective trigger bore 135, and is configured such that when actuated, hydraulic fluid fills a chamber 136 of the trigger bore 135 on a side of the trigger 130 opposite a direction from which the protrusion 125 of the lever 123 strikes the striker 137 of the trigger 130, the hydraulic fluid serving to dampen impact between the protrusion 125 of the lever 123 and the striker 137 of the trigger 130.

In accordance with a further aspect of the invention, a method of adjusting a compression ratio of an internal combustion engine is provided. The method includes, in one aspect, the steps of providing an internal combustion engine having one or more pistons 140 disposed in an upper portion to the engine block, the pistons 140 being connected to a crankshaft 151 by respective connecting rods 153, the crankshaft 151 being carried by an engine block. The method can further include the step of providing a piston position adjusting mechanism 120 including an adjustable cam 122 between a connecting rod 153 and a piston bearing surface 147, selecting a point during an operation cycle of the internal combustion engine to change a compression ratio thereof, and triggering the piston position adjusting mechanism 120 to change a relative spacing between the respective piston 140 and connecting rod 153. The cam 122 can be adjustable by way of being configured to rotatably permit adjustability.

The methods and systems of the present invention, as described above and shown in the drawings, provide for a internal combustion engines that permit advantageous variation in compression ratios, without being overly complicated or expensive to manufacture or maintain. It will be apparent to those skilled in the art that various modifications and variations can be made in the device and method of the present invention without departing from the spirit or scope of the invention. Thus, it is intended that the present invention include modifications and variations that are within the scope of the appended claims and their equivalents.

The invention claimed is:

1. A system for adjusting a compression ratio of an internal combustion engine, the system comprising:

a) one or more pistons disposed in the engine, the pistons being connected to a crankshaft by respective connecting rods, the crankshaft being carried by an engine block;

b) a piston position adjusting mechanism, provided in connection with each piston, comprising:

i) a lever pivotably mounted on each of the connecting rods, adapted and configured to pivot when actuated; and ii) a cam, rotatably mounted with respect to each of the pistons and respective connecting rods, adapted and configured to maintain, at any moment, one of a plurality of spacings therebetween, rotation of the cam by a preselected angle causing a change in relative spacing between a head of the respective piston and small end of the connecting rod;

c) a trigger for actuating each piston position adjusting mechanism, causing pivoting of the lever, engagement between the cam and the lever, and rotation of the cam by the preselected angle; and d) a control for actuating the trigger.

2. The system of claim 1, wherein the lever is resiliently biased against the connecting rod.

3. The system of claim 1, further comprising a ratchet gear and pawl interposed between the lever and the cam, the pawl carried by the lever and the ratchet gear provided in rotationally-fixed position with respect to the cam, pivoting of the lever causing urging of the ratchet gear by the pawl, resulting in rotation of the cam by the preselected angle.

4. The system of claim 1, wherein the piston position adjusting mechanism is adapted and configured such that the cam includes a plurality of angularly offset surfaces, adapted and configured for abutting a cam surface defined on the piston.

5. The system of claim 4, wherein the angularly offset surfaces are substantially planar in configuration.

6. The system of claim 4, wherein the cam is rotationally symmetric, permitting unidirectional rotation of the cam for transitioning between selected compression ratios, determined based on the relative spacing between the head of the respective piston and small end of the connecting rod.

7. The system of claim 1, wherein the cam is adapted and configured to maintain one of two spacings between each piston and its respective connecting rod, depending on a rotational orientation of a cam with respect to the earn surface of the piston.

8. The system of claim 1, wherein each cam includes one or more spacer blocks and a piston pin connecting the spacer blocks.

9. The system of claim 1, further comprising one or more guides adapted and configured to slide linearly with respect to the piston and a bore of the piston, the cam and the piston being mutually connected by way of the one or more guides.

10. The system of claim 9, wherein each of the one or more guides is resiliently connected to the piston by one or more springs, and is urged axially in contact with the piston.

11. The system of claim 10, wherein each of the one or more guides is resiliently connected to the piston by way of a spring engaged with the piston and exerting force on a piston pin, engaged with each of the one or more guides.

12. The system of claim 1, wherein the engine block is a split block, having a main block and a bedplate.

13. The system of claim 12, wherein the trigger is provided in connection with the bedplate.

14. The system of claim 13, wherein the trigger is housed in a cavity formed in the bedplate.

15. The system of claim 1, wherein the trigger is adapted to momentarily move into a position in which a portion of the trigger enters a path of the lever, causing the lever to pivot with respect to the connecting rod.

16. The system of claim 15, wherein the trigger includes a protrusion extending into the path of the lever.

17. The system of claim 16, wherein the trigger is resiliently biased away from the path of the lever and is hydraulically actuatable into the path of the lever.

18. The system of claim 17, wherein the control includes a hydraulic circuit adapted and configured to supply high hydraulic fluid to the trigger, at a pressure sufficient to urge the trigger into the path of the lever, against the biasing force.

19. The system of claim 18, wherein the trigger is held within a trigger bore of a housing, configured such that when actuated, hydraulic fluid fills the trigger bore on a side of the trigger opposite a direction from which the lever strikes the trigger, the hydraulic fluid serving to dampen impact between the lever and the trigger.

20. The system of claim 1, wherein the control is provided in connection with an engine management system, provided in connection with the internal combustion engine, the engine management system determining when to actuate each trigger to adjust a compression ratio of each piston, respectively.

* * * * *